US006278662B1

(12) United States Patent
Gruber

(10) Patent No.: US 6,278,662 B1
(45) Date of Patent: Aug. 21, 2001

(54) CLOCK WITH A TZOLKIN CALENDAR

(76) Inventor: Iris Gruber, Machtolf Weg 56, D-70567 Stuttgart (DE)

( * ) Notice: Subject to any disclaimer, the term of this patent is extended or adjusted under 35 U.S.C. 154(b) by 0 days.

(21) Appl. No.: 09/424,420

(22) PCT Filed: Aug. 8, 1998

(86) PCT No.: PCT/DE98/02347

§ 371 Date: Dec. 2, 1999

§ 102(e) Date: Dec. 2, 1999

(87) PCT Pub. No.: WO99/49367

PCT Pub. Date: Sep. 30, 1999

(30) Foreign Application Priority Data

Mar. 26, 1998 (DE) ..... 298 05 523 U

(51) Int. Cl.[7] ..... G04B 19/24; G04C 17/00

(52) U.S. Cl. ..... 368/28; 368/37; 368/223

(58) Field of Search ..... 368/28–40, 76, 368/80, 223

(56) References Cited

U.S. PATENT DOCUMENTS 4,757,484 7/1988 Pardo .

OTHER PUBLICATIONS

Database Inspec Institute of Electrical Engineers, Stevenage, GB, Inspec No. 753277, J Journal Calendar System and Astronomy of The Maya People. Schalen C., Astronomisk Tidsskrift, 1974, Sweden, ISSN 0004–6345, vol 7, NR 3, pp. 103–108.

*Primary Examiner*—Vit Miska
(74) *Attorney, Agent, or Firm*—Jordan and Hamburg LLP

(57) ABSTRACT

A conventional type clock with a date, hour, minute and seconds display, characterized in that Maya signs are provided instead of the usual hour signs and in that the 20 Tzolkin day symbols are applied to an outer ring that can rotate according to the clock movement. The meaning of each of the respective combinations of Maya signs and Tzolkin day symbols can be inferred from the corresponding Tzolkin calendar.

7 Claims, 5 Drawing Sheets

THURSDAY, JANUARY 1st, 1999

Noj

VERBALLY: WISDOM, KNOWLEDGE, IDEA

SYMBOL FOR CREATIVENESS, INNOVATION AND COMPETENCE CONNECTED WITH FAR-SIGHTENESS
A DAY FOR DEVELOPING INGENIOUS, UNCONVENTIONAL AND CREATIVE SOLUTIONS FOR EVERYDAY PROBLEMS AND TO PLAN INNOVATIVE FORWARD-LOOKING PROJECTS

BIRTHDAYS:

HOLIDAY:

NOTES:

| | | TOPIC: | COMMUNICATION: | ✉ | ☎ |
|---|---|---|---|---|---|
| 08 | | | | | |
| | | | | | |
| 09 | | | | | |
| | | | | | |
| 10 | | | | | |
| | | | | | |
| 11 | | | | | |
| | | | | | |
| 12 | | | | | |
| | | | | | |
| 13 | | | | | |
| | | | | | |
| 14 | | | | | |
| | | | | | |
| 15 | | | | | |
| | | | | | |
| 16 | | | | | |
| | | | | | |
| 17 | | | | | |
| | | | | | |
| 18 | | | | | |
| | | | | | |
| 19 | | | | | |
| | | | | | |
| 20 | | | | | |
| 4th WEEK | | | | | |

TO BE DONE

MEANING OF SIGNS IN THE TZOLKIN DAY ROUTINE
THE NUMBERS IN COMBINATION WITH THE 20 DAY SYMBOLS EXPRESS DIRECTION AND DIMENSION, RESPECTIVELY:

1 HOMOGENEOUS

2 COMPLEMENTARY
THERE ARE TWO SIDES TO EVERYTHING, DAY AND NIGHT, POSITIVE AND NEGATIVE, CONFLICT AND SOLUTION

3 THREE-DIMENSIONAL
TIMES: PAST, PRESENT, FUTURE
LEVEL: HEAVEN, EARTH, UNDERWORLD
FORMS OF ENERGY: TIME, SPACE, MOVEMENT

4 MULTILATERAL
DIRECTIONS: EAST, WEST, SOUTH, NORTH
COLOR OF THE SKIN: BLACK, WHITE, RED, YELLOW
SEASONS: SPRING, SUMMER, AUTUMN, WINTER

5 BALANCED
LIVING CONDITIONS: INDIVIDUAL, FAMILY, SOCIAL ENVIRONMENT, ENVIRONMENT, UNIVERSE

6 GOOD-NATURED HUMAN BEING
MENTAL AND PHYSICAL EQUILIBRIUM BY HANDS, LEGS, HEAD, HEART

7 MALE
TO RECEIVE ENERGIES FROM NATURE

8 TO MAKE CONSISTENT WITH ONE ANOTHER
BASIS AND LEADERSHIP, IN ANALOGY TO THE STRUCTURE OF A PYRAMID: THE BASIS FORMS THE FOUNDATION

9 CREATIVE, FEMALE
NATURE: FERTILITY OF THE SOIL
MANKIND: THE UNITY BETWEEN THE GENERATIONS

10 SIMULTANEOUS
WHAT IS ON THE EARTH, IS ALSO IN THE HEAVEN.
THE MICROCOSM FUNCTIONS LIKE THE MACROCOSM.

11 SINGULARITY
EACH HUMAN BEING IS DIFFERENT

12 UNIVERSAL
SUM OF ALL THINGS

13 IDEAL, MAXIMAL
ALL FORMS OF ENERGY FIT TOGETHER

FIG.5

CLOCK WITH A TZOLKIN CALENDAR

BACKGROUND

Tzolkin is a time division which contains criteria for planning time. Such a timely rhythm originating from the Maya philosophy is known in science, however, does not find any application. The present day calendar is based on a quantitative division into centuries, years, months, weeks, days, minutes, and seconds. Tzolkin includes qualitative criteria for planning time.

Tzolkin is a component of the Maya calendar. In their calendar systems the Mayas, who are known as experts in astronomy, mathematics, architecture, and chronology, combine three kinds of measuring time, which make it possible to exactly calculate over thousands of years and, hence, to describe the development of the future concerning time. Thus time becomes something calculable due to repetitions in definite intervals, rather than something unpredictable.

The chronology begins on $11^{th}$ August, 3114 BC and consists of the solar calendar of 365 days, of the Tzolkin rhythm with 260 days and of the Choltun period of 52 years.

The solar calendar and Tzolkin function like a cycle, that is, the rhythms of time regularly return to the starting point, just as each night is followed by a day again—the cycle of one day. Only Choltun runs linearly, that is, it sums up the years of the sun periods and of the Tzolkin. Tzolkin is a rhythm of 260 days and is based upon the calculations of the influence the Moon, Mars, and Venus have on the Earth, and corresponds to the development of man. Said 260 days are a combination of 20 units which are 13 times repeated. By the combination of each of the 20 units and the symbols of a day, respectively, with any of the numbers 1 through 13, each of the 260 days gets a unique standing, and provides informations on potential developments. After 260 days the cycle starts all over again.

The characteristics of the days build up one upon the other, complete each other, change their value by combination with the numbers. The Choltun is the sum of 52 years, for the solar calendar and Tzolkin start again after 52 years with exactly the same date. Thus, a new period starts, that is, a new stage in the development of the human society.

Tzolkin combines modern life with the originality. He combines modern time management with the naturally set conditions, since the Tzolkin rhythm has developed from nature. Not only is the year divided into 365 days, 52 weeks, and 12 months, but each day provides a help for finding one's way. Thus, each day gets an own, an exceptional value which can be made up individually. So time is not only a division into sections, but also division of ideas, thoughts, and activities. The 260 days provide an orientation as concerns their content by the symbols of the days and the intellectual orientation by the associated numbers.

SUMMARY OF THE INVENTION

The Tzolkin clock and the Tzolklin calendar are a modern combination between man, nature and techniques for the way of life in occupation and in private life. Thereby, there is a new perspective presented on time, meaning, and cultural background for the personal planning of time.

The signs, numbers, and symbols are the same on the clock and in the calendar. A description of and introduction into the meaning of the Tzolkin day symbols and the Tzolkin numbers are part of the calendar.

BRIEF DESCRIPTION OF THE DRAWINGS

FIGS. 1–5 illustrate the Tzolkin clock of the invention.

Figure 1:
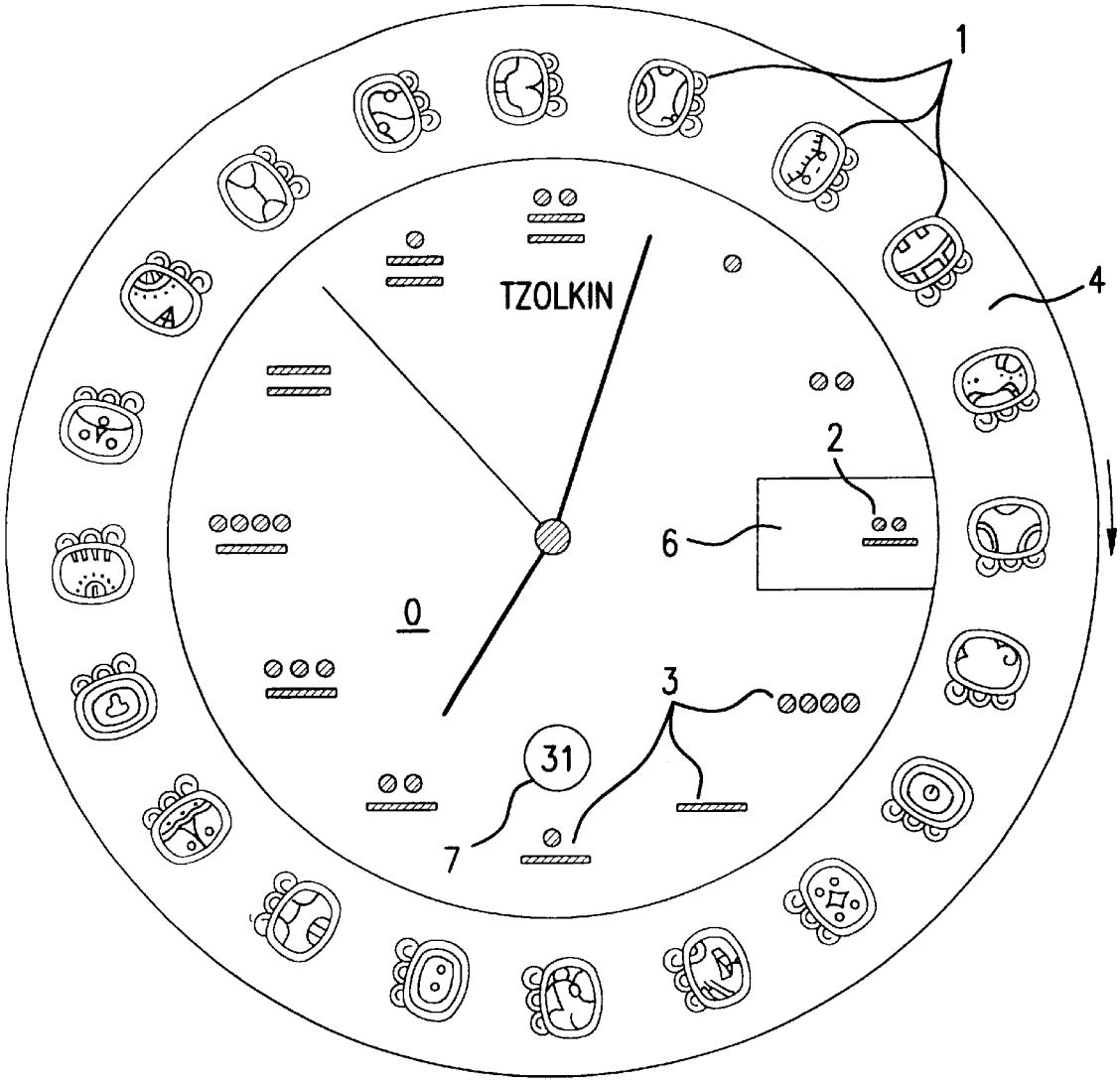
Figure 2:
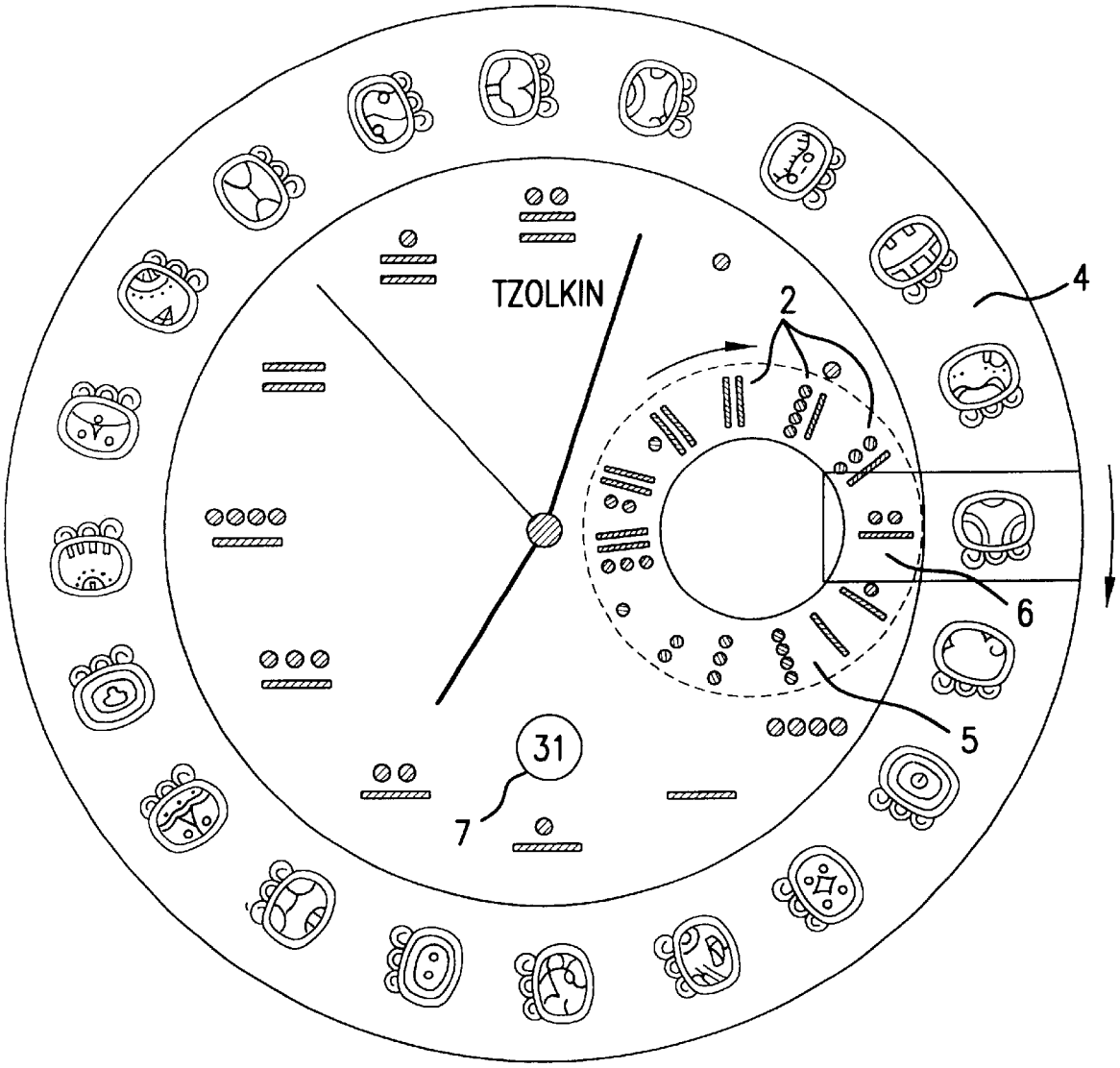

An outer ring (4), upon which 20 Tzolkin day symbols (1) are provided, is integrated in the dial (0) of the clock, said ring (4) is rotatably seated and driven by the clock interior. The drive is achieved by the interior of the clock, in that, after one day (24 hours), said outer ring (4) is clockwise rotated on by one Tzolkin day symbol (1). Instead of the hour signs which are usual up to now Maya signs (3) are provided from 01:00 to $12{:}00^{h}$ on the dial (0). On an inner part of the clock, there is provided a rotatable inner ring (5) which is driven by the interior of the clock and upon which 13 Tzolkin numbers (2) are attached. The inner ring (5) is driven by the interior of the clock in such a way that the same is rotated on by one Tzolkin number (2) after one day (24 hours). By means of a viewing window (6), the respective Tzolkin day number (2) is visible which, in this way, is located adjacent to the respective day symbol (1) on the outer ring (4).The combination of the respective day symbol (1) and the Tzolkin number (2) which can be read from the viewing window (6) results in the meaning of the respective day which meaning is described in more detail in the calendar which is added to the inventional clock.

Figure 3:
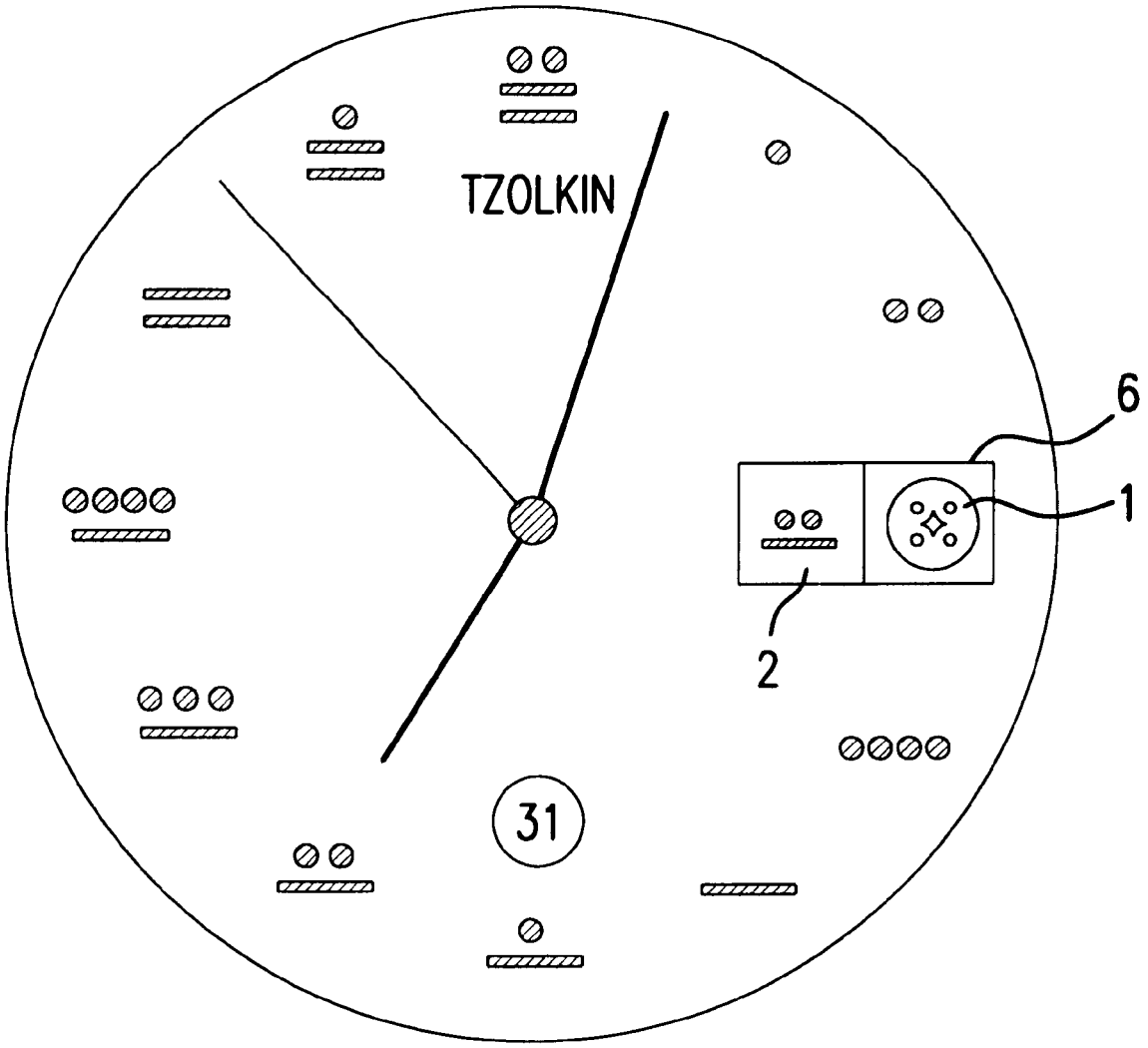

FIG. 3 represents a further embodiment of the inventional clock. This alternative of embodiment differs from the embodiment which has been described up to here in that the outer ring (4) with the 20 Tzolkin day symbols (1) provided on it, is located hidden under the dial (0) which, by an interior clock drive, is also rotated on by one day symbol (1) after one day (24 hours). On a respective day, the respective Tzolkin day symbol (1) is rendered visible in the viewing window (6) right adjacent to and together with the respective Tzolkin number (2).

The embodiment of the inventional clock is at will and can be manufactured as a wall clock, but preferably as a wrist-watch.

Figure 4:
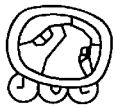

With respect to the Tzolkin calendar, the user of the inventional clock can read the former either in the form of a simple description of the meaning of the symbolism and of the Tzolkin numbers for each day, or he can, however, also use a Tzolkin day routine in which the respective Tzolkin day symbols and the Tzolkin numbers and a combination of the same can be found, besides a customary and conventional calendar. To this end, it is referred to FIGS. 4 and 5.

LIST OF REFERENCE NUMERALS

| | |
|---|---|
| 0 | dial |
| 1 | Tzolkin day symbol |
| 2 | Tzolkin number |
| 3 | Maya sign |
| 4 | outer ring |
| 5 | inner ring |
| 6 | viewing window |

What is claimed is:

1. Clock with a Tzolkin calendar comprising a date, hour, minute and seconds display of conventional design, a dial, a clock mechanism for sequentially displaying 20 Tzolkin day symbols and 13 Tzolkin numbers, and means for displaying time from 01:00 to 12:00h on said dial.

2. Clock with a Tzolkin calendar as claimed in claim 1, wherein Maya signs of from 01:00 to 12:00h are provided on the dial instead of the heretofore usual hour signs.

3. Clock with a Tzolkin calendar as claimed in claims 1 or 2, further including an outer ring (4), rotatable by the clock mechanism, on which are provided 20 Tzolkin day symbols, said ring is rotated by the clock mechanism one symbol every 24 hours.

4. Clock with a Tzolkin calendar as claimed in claim 1 wherein 13 Tzolkin numbers are provided on an inner ring rotatable by the clock mechanism, said ring is rotated one by one number after one day (24 hours) and, by means of a viewing window, the respective number with the associated Tzolkin day symbol can directly be read from the dial.

5. Clock with a Tzolkin as claimed in claims 1 or 2 wherein the combination of the respective daily readable Tzolkin day symbol with the respective Tzolkin number has a meaning described in more detail in the Tzolkin calendar.

6. Clock with a Tzolkin calendar as claimed in claims 1 or 2, further comprising a calendar in which the meaning of the Tzolkin day symbols, the meaning of the Tzolkin numbers and, resulting therefrom, the respective combinations between the day symbols and numbers are described.

7. Clock with a Tzolkin calendar as claimed in claim 1 or 2, further comprising an outer ring with the 20 Tzolkin day symbols provided thereupon and hidden under the dial, a viewing window, the respective day symbol being adjacent the respective Tzolkin number and being readable with the latter in the viewing window.

* * * * *